US006495779B1

(12) United States Patent
Dobler et al.

(10) Patent No.: US 6,495,779 B1
(45) Date of Patent: Dec. 17, 2002

(54) CONTACT ASSEMBLY ON A PRESELECTOR

(75) Inventors: Claudia Dobler, Pielenhofen (DE); Rolf Lauterwald, Pettendorf (DE); Richard Schmid, Fussenberg (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 0 days.

(21) Appl. No.: 09/980,723

(22) PCT Filed: Feb. 29, 2000

(86) PCT No.: PCT/EP00/01691

§ 371 (c)(1),
(2), (4) Date: Nov. 15, 2001

(87) PCT Pub. No.: WO00/72341

PCT Pub. Date: Nov. 30, 2000

(30) Foreign Application Priority Data

May 22, 1999 (DE) ..... 199 23 722

(51) Int. Cl.[7] ..... H01H 1/06

(52) U.S. Cl. ..... 200/275; 200/280; 200/293; 200/304

(58) Field of Search ..... 200/275, 280, 200/281, 284, 293, 304, 305

(56) References Cited

U.S. PATENT DOCUMENTS 3,590,196 A * 6/1971 Kouk ..... 200/161
4,668,845 A * 5/1987 Izami ..... 200/51 R
4,996,401 A * 2/1991 Park ..... 200/527
5,329,083 A * 7/1994 Lai ..... 200/302.2
5,475,751 A * 12/1995 McMonagle, Jr. et al. .. 379/355

FOREIGN PATENT DOCUMENTS

DE 7121024 5/1971
DE 8229692 3/1984

* cited by examiner

*Primary Examiner*—Elvin Enad
*Assistant Examiner*—Kyung S. Lee
(74) *Attorney, Agent, or Firm*—Herbert Dubno; Andrew Wilford

(57) ABSTRACT

The invention relates to a contact assembly mounted on a preselector of a step switch, where the fixed preselector contact has a contacting ring that can be interconnected. The appropriate design of the contact and of the openings in an insulating material housing, in which said contact should be fixed, as well as an additional positioning part enable a simple mounting and a reliable fixing which simultaneously prevents turning.

6 Claims, 4 Drawing Sheets

CONTACT ASSEMBLY ON A PRESELECTOR

CROSS REFERENCE TO RELATED APPLICATIONS

This application is the U.S. national phase of PCT application PCT/EP00/01691 filed Feb. 29, 2000 with a claim to the priority of German patent application 19923722.0 itself filed May 22, 1999.

FIELD OF THE INVENTION

The invention relates to a contact arrangement for a preselector of a step switch.

It has long been standard practice to provide a step switch with a preselector to enlarge the effective setting range. It serves either as a coarse selector for connecting or cross connecting the step windings or as converter for controlling the step winding at the start or the end of a coarse-adjustment step. Such a known preselector normally is comprised for each phase of the three fixed preselector contacts with one of the two fixed contacts, the plus or the minus contact, being connected with the third contact, the null contact.

The Bulgarian product literature "On-load Tap changer Type RS 12" and "On-load Tap Changer Type 16" describe a preselect or that extends longitudinally outside the insulating cylinder of the step switch. The fixed preselector contacts are arrayed in a line, have a ball-shaped contact surface, and are switched in the above-described manner by a longitudinally shiftable switching rod with a contact bridge.

German 93 08 492 describes a preselector that is set up as a multistage coarse selector and that has a separate housing. Actuation of this preselector takes place through a rotatable switching shaft. The fixed preselector contacts here also have a ball-shaped contact surface that is switchable by means of movable contacts mounted on and pivotal with the rotatable switching shaft.

Finally German 198 36 463 proposes a preselector that is mounted as a subassembly separate from the step switch in a separate insulating housing that holds a longitudinally shiftable switching rod. The fixed preselector contacts here are circular and concentrically arrayed around the switching rod in separate planes inside the insulating housing. Mounting such circular concentrically fixed preselector contacts inside such a tubular insulating housing has shown itself to be extraordinarily difficult. It is necessary to take care that for electrical reasons the entire tubular insulating housing of the preselector be made of one piece and also have no large openings, e.g. interruptions of the insulation, while however such openings are necessary in order to get the preselector contacts inside and secure them there.

It is an object of the invention to overcome this problem and provide a contact arrangement according to the invention where the circularly shaped fixed preselector contacts can be mounted in a simple manner in a tubular insulating housing that holds the preselector.

This object is achieved with the contact according to the invention having the features of the first claim. The dependent claims relate to particularly advantageous further embodiments of the invention.

The contact arrangement according to the invention has many advantages: First the fixed preselector contacts itself forms by its shape an ideal electrode and optimally uses the available inside diameter of the insulating sleeve in which it is mounted. It is mounted from inside by being as described more closely below engaged into the interior and there mounted such that its connection means extends outward through a respective hole. The entire contact arrangement is equally usable for vertical or horizontal connections outside the insulating sleeve. Furthermore the contact arrangement according to the invention makes possible a rotationally fixed and tolerance-equalizing mounting of the preselector contacts and finally makes possible the mounting of additional shielding or shield rings for voltage protection.

The invention is more closely described in the following with reference to the drawing.

Therein:

Figure 5A:
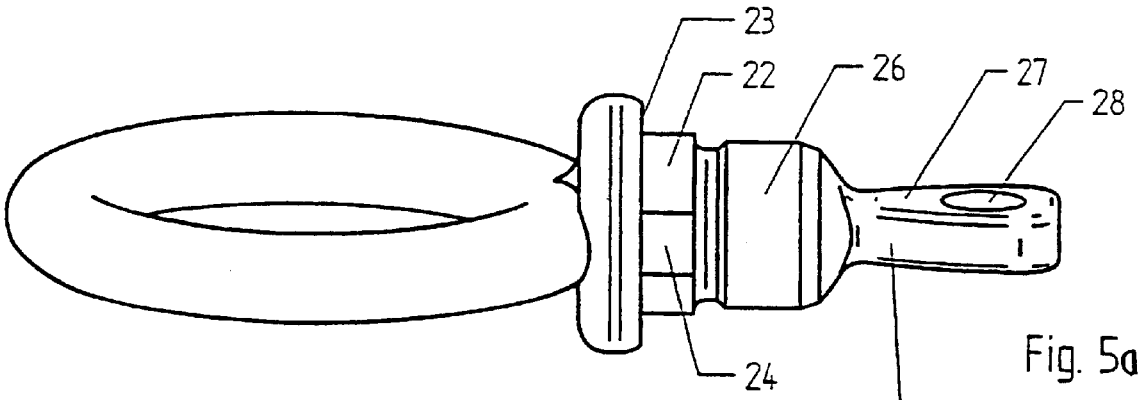
Figure 5B:
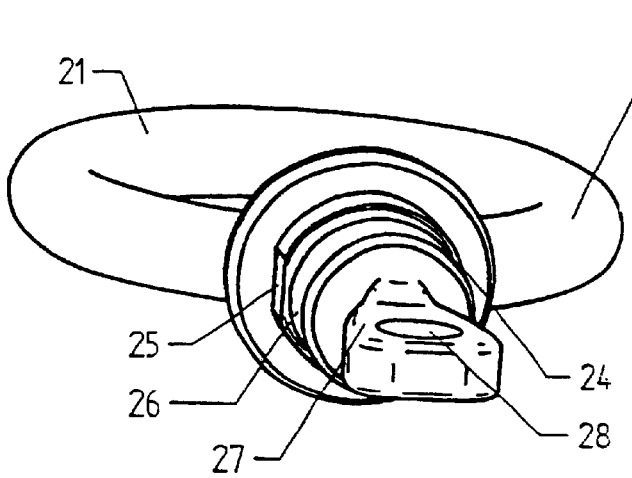
Figure 6B:
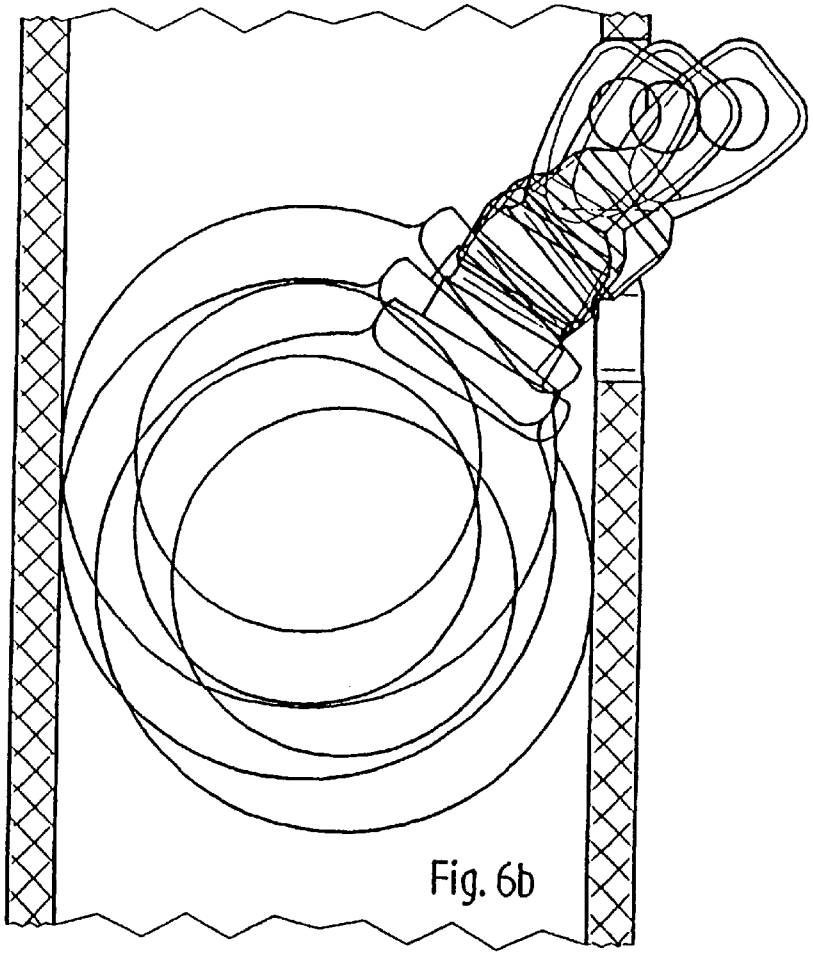
Figure 6A:
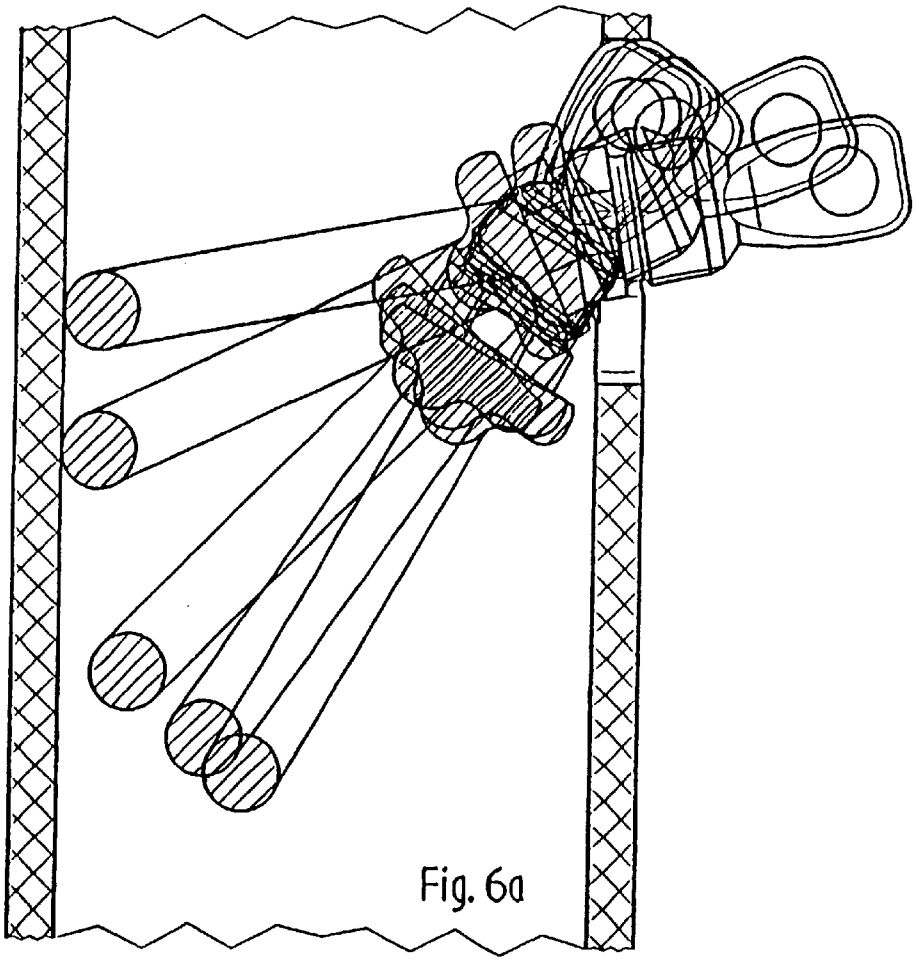

FIG. 5*a* is a fixed preselector contact from above;

FIG. 5*b* is a fixed preselector contact from in front;

FIG. 6*a* shows the installation of a fixed preselector contact in the tubular insulating housing with a vertical connection part; and FIG. 6*b* shows the installation with a horizontal connection part.

Figure 1:
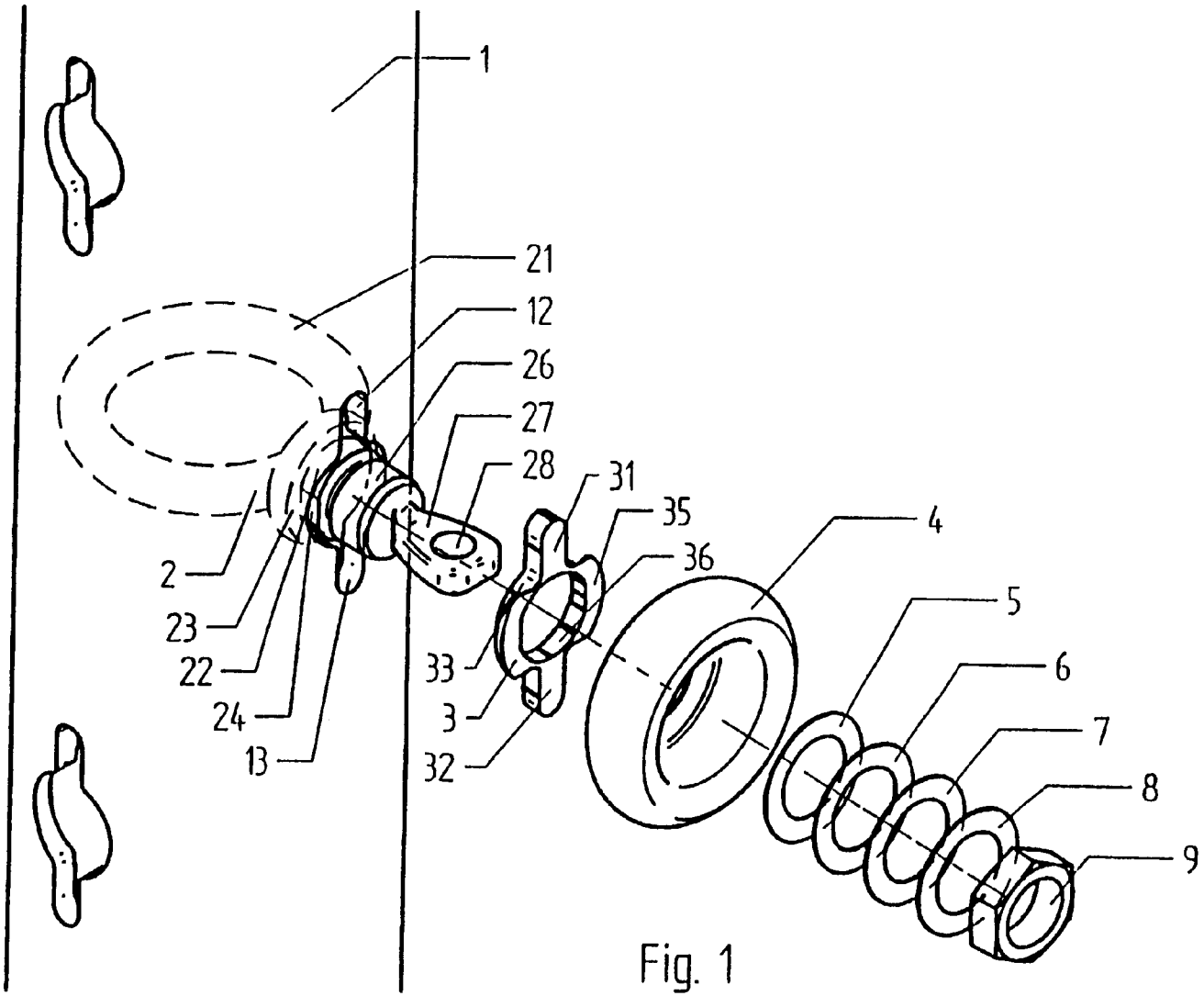
FIG. 1 is perspective view (exploded) of a contact arrangement according to the invention.
Figure 2:
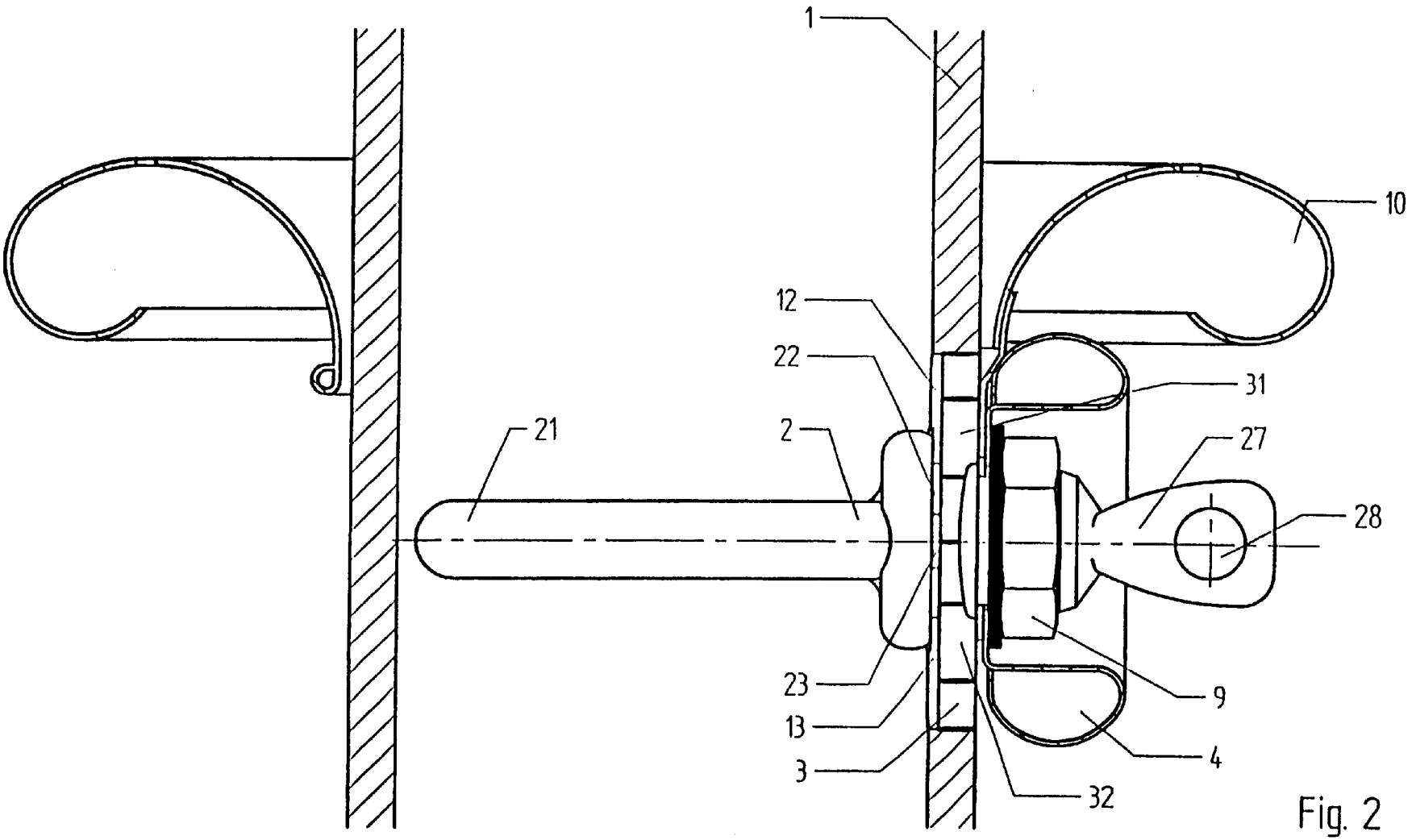
FIG. 2 is a side sectional view of this contact arrangement.
Figure 3:
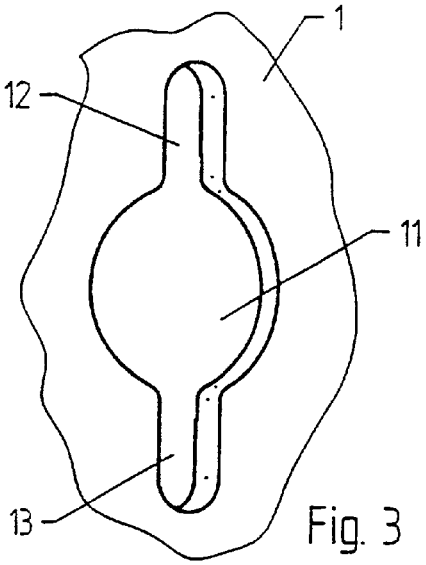
FIG. 3 is a detail of the tubular insulating housing.
Figure 4:
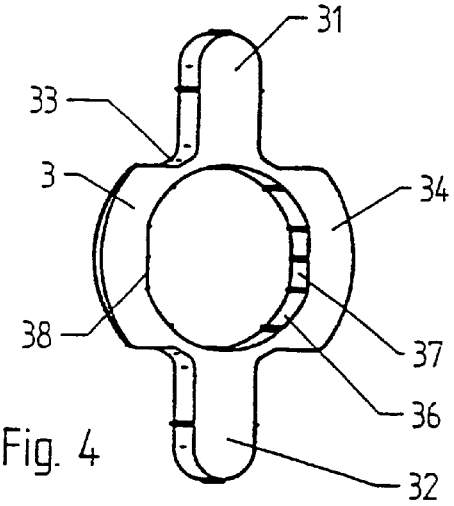
FIG. 4 shows only a positioning part of the arrangement according to the invention.

FIGS. 1 through 5 show the contact arrangement according to the invention overall or as individual installations or details. A tubular insulating housing 1 has a hole 11 for each preselector contact to be installed. For simplicity's sake only one of these holes is shown. The hole 11 is extended longitudinal of the insulating housing 1 upward in order to form an upper mounting slot 12 and downward to form a lower mounting slot 13 so that overall an opening is produced that has the shape shown in detail in FIG. 3. The fixed preselector contact 2 has the actual contact ring 21 that is positioned inside the insulating housing concentrically to the unillustrated drive shaft and that is engageable by the also unillustrated movable preselector contact or bridge. Each fixed preselector contact 2 further has a contact stem 22 that extends outward through the respective hole 11 of the insulating housing 1. An abutment 23 that is formed as an electrode ensures a solid engagement of the preselector contact 2 against the inside surface of the insulating housing 1. The contact stem 22 has on its otherwise cylindrical surface two lateral stop faces 24 and 25 whose function is described in more detail below. The contact stem 22 has a forward threaded region 26 and a rear connection part 27 with a connection bore 28. The respective electrical connection lines are connected there and lead to fixed preselector contacts. The contact arrangement according to the invention further has a positioning part 3 formed of insulating material. This is shown in detail in FIG. 4. The positioning part 3 has an upper mounting slot cover 31 and a lower mounting slot cover 32 that extend outward as wings. These two mounting-slot covers 31 and 32 have the shape of the above-described mounting slots 12 and 13 of the respective hole 11. In addition the positioning part 3 has an outer circular shape 33 that corresponds to the diameter of the hole 11. Furthermore it has an inner circular shape 36 that corresponds to the diameter of the contact stem 22. Two lateral stop formations 37 and 38 are formed on this inner circular shape 36 that are complementary to the respective stop faces 24 and 25. When mounted in place, the positioning part fits in the hole 11 and the mounting slots 12 and 13 and simultaneously is effective through the respective stop faces 24 and 25 on the fixed preselector contact 2 and the stop formations 37 and 38 as a rotation preventer for the fixed preselector contact. The positioning part 3 is formed with an abutment 35 that prevents this part from slipping into the insulating housing 1. The outwardly projecting contact stem 22 is, after being installed as described, fitted with a shield ring 4; a nut 9 and intermediate washers 5, 6, 7, and 8 secure the entire arrangement with the nut 9 fitted to the screw thread 26. It is also possible to mount a further preselector shield without additional mounting means as shown in FIG. 2.

FIG. 6 shows the steps of mounting a fixed preselector contact 2. One can see that the contact is slid by an unillustrated tool or pulling device inside into the region of the respective hole 11 with the mounting slots 12 and 13 where it is to be mounted. Then the fixed preselector contact 2 with the contact stem 22 is slowly pivoted with the integral connection face 28 swinging outward through the respective hole 11 and the two mounting slots 12 and 13. Once the preselector contact 2 reaches its final position, that is the contact ring 21 is horizontal, the positioning part 3 is mounted from outside and thus the rotation preventer is created by the interaction of the stop faces 24 and 25 and the stop formations 37 and 38. Finally the entire arrangement is locked in place by screwing down the nut 9 on the screw thread 26 with if necessary interposition of further elements to complete the installation.

Numerous geometric shapes are possible for the stop facts 25 and 25 and the cooperating stop formations 37 and 38; the arrangement is not limited to the here illustrated lateral flats on the contact stem 22.

The positioning part 3 is of a thickness that corresponds to that of the tubular insulating housing so that when installed it is braced inwardly on the abutment 23 and is flush with the surfaces of the insulating housing 1.

In this manner the fixed preselector contact 2 is mounted solidly and so it cannot rotate: it is itself fixed by the interacting stop faces 24 and 25 and the stop formations 37 and 38 on the positioning part. This in turn engages with the upper and lower projections 31 and 32 in the upper and lower mounting slots 12 and 13 of the hole 11 to be fixed in the insulating housing 1. The nut 9 installed from outside on the screw thread 26 ensures a solid force-transmitting connection.

FIG. 6 also shows that the described mounting is effective when the corresponding connection part 27 in the installed condition is horizontal or vertical. In the former situation the mounting takes place with the contact ring 21 vertical and before fitting the positioning part 3 the stem 22 is rotated from outside through 90°. In the latter case no such rotation is necessary.

PARTS LIST tubular insulating housing 1
fixed-contact holding hole 11
upper mounting slot 12
lower mounting slot 13
fixed preselector contact 2
contact ring 21
contact stem 22
abutment 23
first lateral stop face 24
second lateral stop face 25
screwthread 26
connection part 27
connection bore 28
positioning part 3
upper mounting slot cover 31
lower mounting slot cover 32
outer circular shape 33
radial abutment 34 35
inner circular shape 36
first stop formation 37
second stop formation 38
shield 4
washer 5
washers 6
washer 7
washer 8
nut 9
preselector shield 10

What is claimed is:

1. A contact arrangement of a step-switch preselector, the arrangement comprising:

an elongated insulating tube formed with at least one laterally throughgoing hole and with a laterally throughgoing and longitudinally extending slot opening into the hole;

a positioning part having an annular central part complementary to the hole and formed with a bore having a stop formation and a tab projecting longitudinally from the central part and substantially complementary to the slot, the central part and tab fitting complementarily into the hole and slot;

a contact ring oriented inside the tube, level with the hole, and in a plane extending transversely to the tube;

a stem extending unitarily from the ring through the bore of the positioning part, having a stop face fitting with the stop formation, fitting complementarily with the bore and stop formation, and having a contact part outside the tube and of a thickness smaller than a width of the slot such that the stem and contact part can be fitted through the hole and slot from inside the tube; and securing means engaging the stem outside the tube for fixing the contact ring and positioning part to the tube.

2. The contact arrangement defined in claim 1 wherein the contact ring is unitarily formed with an abutment bearing laterally outward on an inner surface of the tube and positioning part.

3. The contact arrangement defined in claim 1 wherein the tube is formed at the hole with two such slots extending oppositely and longitudinally from the hole, the positioning part being formed with two such tabs complementary to the slots.

4. The contact arrangement defined in claim 1 wherein the positioning part has a thickness generally corresponding to a wall thickness of the tube.

5. The contact arrangement defined in claim 1 wherein the stem is threaded and the securing means is a nut.

6. The contact arrangement defined in claim 5, further comprising a shield secured outside the tube around the stem by the nut.

* * * * *